US005137209A

United States Patent [19]

Roberts et al.

[11] Patent Number: 5,137,209

[45] Date of Patent: Aug. 11, 1992

[54] BAYONET HANDLE PACKAGE

[75] Inventors: John T. Roberts, Clover; Claude E. Monsees, Ft. Mill, both of S.C.; Larry J. Mattson, Charlotte, N.C.; Ralph S. Goldstein, Lake Wylie, S.C.; Ronald H. Wanless, Lebanon, Ohio; Charles L. Gunn, Lawrenceburg, Ind.; Harold Davis, Reading, Ohio; Robert J. Apke, Cincinnati, Ohio

[73] Assignee: The Procter & Gamble Company, Cincinnati, Ohio

[21] Appl. No.: 566,159

[22] Filed: Aug. 10, 1990

[51] Int. Cl.[5] ..... B65D 25/22

[52] U.S. Cl. ..... 229/117.25; 229/117.19

[58] Field of Search ..... 229/117.19, 117.23, 229/117.24, 117.25, 117.26

[56] References Cited

U.S. PATENT DOCUMENTS

| | | | |
|---|---|---|---|
| 205,355 | 6/1878 | Cole . | |
| 2,109,034 | 2/1938 | Seifer | 229/117.24 |
| 2,128,723 | 8/1938 | Zettler | 229/117.19 |
| 2,289,824 | 7/1942 | Brogden | 229/117.19 |
| 2,341,930 | 2/1944 | Lipet . | |
| 2,401,664 | 6/1946 | Robins . | |
| 2,405,914 | 8/1946 | Van Rosen | 229/117.24 |
| 2,443,256 | 6/1948 | Lebold . | |
| 2,645,406 | 7/1953 | Robins . | |
| 2,791,368 | 5/1957 | Kramer et al. | 229/117.24 |
| 3,107,841 | 10/1963 | Fink | 229/117.19 |
| 3,134,531 | 5/1964 | Hardy, Jr. | 229/117.19 |
| 3,140,814 | 7/1964 | Ellis | 229/117.24 |
| 3,144,196 | 8/1964 | Sindars | 229/117.24 |
| 3,286,910 | 11/1966 | Offenburger | 229/117.19 |
| 3,456,865 | 7/1969 | Frank | 229/117.19 |
| 3,695,418 | 10/1972 | Gwozdz | 229/117.24 |
| 3,700,160 | 10/1972 | Farrell | 229/174 |
| 3,913,738 | 10/1975 | Olsen | 229/117.12 |

FOREIGN PATENT DOCUMENTS

| | | | |
|---|---|---|---|
| 1396064 | 3/1965 | France | 229/117.24 |
| 1017896 | 1/1966 | United Kingdom | 229/117.26 |

*Primary Examiner*—Stephen Marcus
*Assistant Examiner*—Christopher McDonald
*Attorney, Agent, or Firm*—E. Kelly Linman; Thomas H. O'Flaherty; Richard C. Witte

[57] ABSTRACT

A generally-flat bayonet handle is provided having an elongated handle section for gripping by the consumer. Extending from each terminus of the handle section is an elongated neck section having a width less than the width of the handle section. Respective ends of the bayonet handles are formed by barb heads attached to the neck sections. Each barb head has thereon at least two barbs which, when inserted into appropriately placed apertures on the sides of a soap or detergent powder carton, are ensnared on a lip of the apparatus and thereby maintain the engagement of the handle on the carton. The combination of the bayonet handle and the carton provide a novel soap or detergent powder package.

15 Claims, 3 Drawing Sheets

BAYONET HANDLE PACKAGE

BACKGROUND OF THE INVENTION

This invention relates generally to the art of handles and more particularly to a handle for a package of soap powder or the like.

Initially, packages of soap or detergent powder were sold without handles or carrying means of any kind. Since these packages tended to be heavy and bulky, transport by a consumer from the market to the home was often an onerous task. This pronounced problem in the marketing of soap and detergent powder soon led to the development of carrying handles for the packages. Typically, such handles were small plastic strips stapled or glued to the top of the package. These small handles functioned well until recent developments in the industry rendered them obsolete.

Detergent powder has, in the past, been puffed with air to lower its density. This was done not in an effort to exaggerate the amount of product, but was necessary due to problems of solubility. The detergent simply would not dissolve properly in household washing machines if sold at its natural density. Advances of late in the art have led to detergents which dissolve sufficiently at their natural density. It is anticipated that these new detergents will soon become the industry standard. As the new detergents are highly concentrated, however, precise measurements of the product are required with each wash. To facilitate this per-use measurement, some manufacturers have chosen to include with the packages of detergent a single washload measuring scoop. So that adequate access to the product may be provided for effective scooping, it has been found that the entire top of the package should hinged and opened as a flap. Upon opening, however, a handle on the top becomes useless.

Therefore, a handle constituting an elongated plastic strip and extending completely across the top of the package has been developed. Attachment of the handle to the sides of the package is achieved with rivets. While a handle usable with the new packages of concentrated detergent is so provided, significant limitations and disadvantages remain.

One of these disadvantages is in the shipping of the packages. The rivets protrude form the otherwise planar surfaces of the package. As such, fewer packages can be stacked and shipped together. This is the case both after the package is filled with detergent and before, when the package is an unfolded flat piece of cardboard or the like.

Furthermore, the riveting process has proven slow. As such, fewer packages are produced for a given period of time. This inefficiency adds to the overall cost of the product which the eventual consumer will have to pay.

The riveted handle has also been found to have an adverse environmental impact. Specifically, the rivets have been difficult to remove from the paper package when recycling of the paper has been desired. The riveted handle has therefore served to discourage the recycling of these packages.

SUMMARY OF THE INVENTION

It is thus an object of the invention to provide a novel carrying handle for a carton of soap powder or the like.

It is a further object of the invention to provide a carrying handle for a carton of concentrated soap or detergent powder which does not require the use of rivets, staples or other such means of attachment.

It is also an object of the invention to provide a novel package for the containment and transportation of particulate material, such as high concentration soap or detergent powder.

These as well as other objects are accomplished by a generally flat elongated bayonet handle. The bayonet handle has an elongated handle section for gripping by the consumer. Extending from each terminus of the handle section is an elongated neck section having a width less than the width of the handle section. Respective ends of the bayonet handle are formed by barb heads attached to the neck sections. Each barb head has thereon one or more barbs. When the barb heads are inserted into appropriately placed apertures on the sides of a soap or detergent powder carton, the barbs are ensnared on a lip of the apertures and thereby maintain the engagement of the handle on the carton. A novel soap or detergent powder package is thereby provided.

DETAILED DESCRIPTION

Figure 1:
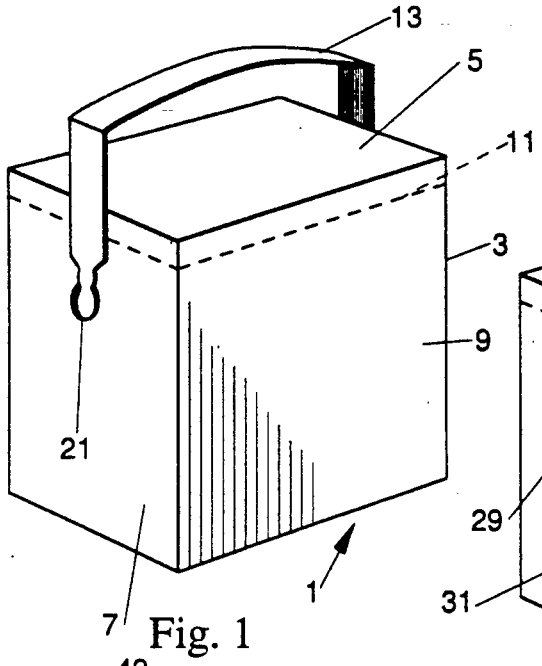
FIG. 1 is a perspective view of a package for the containment and transportation of soap powder or the like showing the bayonet handle of the invention in the engaged carrying position.

In accordance with the invention, it has been found that a bayonet handle may be used to provide a carrying means for a carton of the type as may be used for the containment and transportation of soap or detergent powder or other particulate material Barb heads located on the ends of the handle are inserted through apertures on the carton. The barbs are ensnared by an upper lip of the apertures to ensure engagement of the handle by the carton. When a carton is so equipped with a bayonet handle, a novel package with many advantages over that of the prior art is realized FIG. 1 illustrates a preferred embodiment of an improved package 1 constructed in accordance with the invention. Package 1 includes a carton 3, within which soap or detergent powder product is packed. Carton 3 is of a generally boxlike configuration. As such, it has a rectangular top 5 opposite a rectangular bottom, a left narrow rectangular side 7 opposite a right narrow rectangular side and a front broad rectangular side 9 opposite a back broad rectangular side. Access to the product within carton 3 is obtained by first breaking perforated seam 11. Then, top 5 is hinged by fashioning a bend in the back broad rectangular side. In this way, a measuring cup which may be provided with the product can be initially retrieved and thereafter used to accurately measure per-use quantities of product.

Carrying means for the container 3 are provided by a straplike, flat, elongated bayonet handle 13, having a generally uniform thickness, which, when in use, extends completely over top 5. Generally, the handle will be constructed of a single piece of resilient, plastic material. While many plastics are suitable for this purpose, recycled polyethylene is particularly useful as it has been found to have a greater tensile strength than virgin material Referring still to FIG. 1, handle 13 extends into handle insertion aperture 21, which is located near top 5 on side 7. An identical aperture is similarly located on the right narrow rectangular side. The combination of the apertures and the configuration of the handle 13 maintains the engagement of handle 13 with carton 3.

Figure 2:
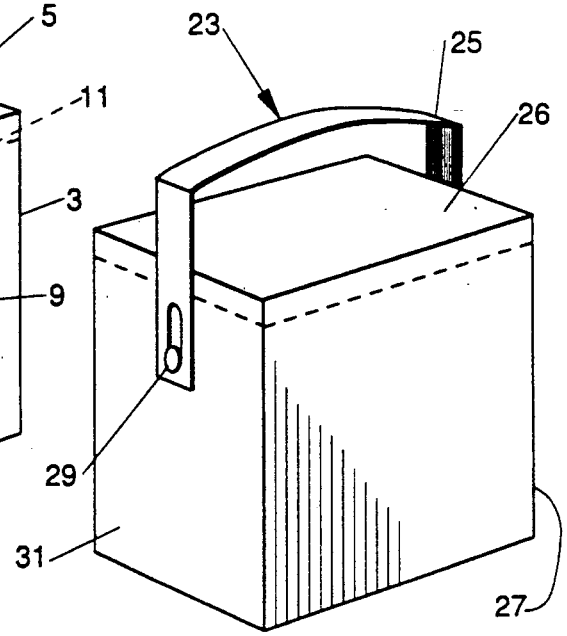
Fig. 2 Prior Art
FIG. 2 is a perspective view of a prior art riveted handle high concentration detergent powder package.
Figure 3:
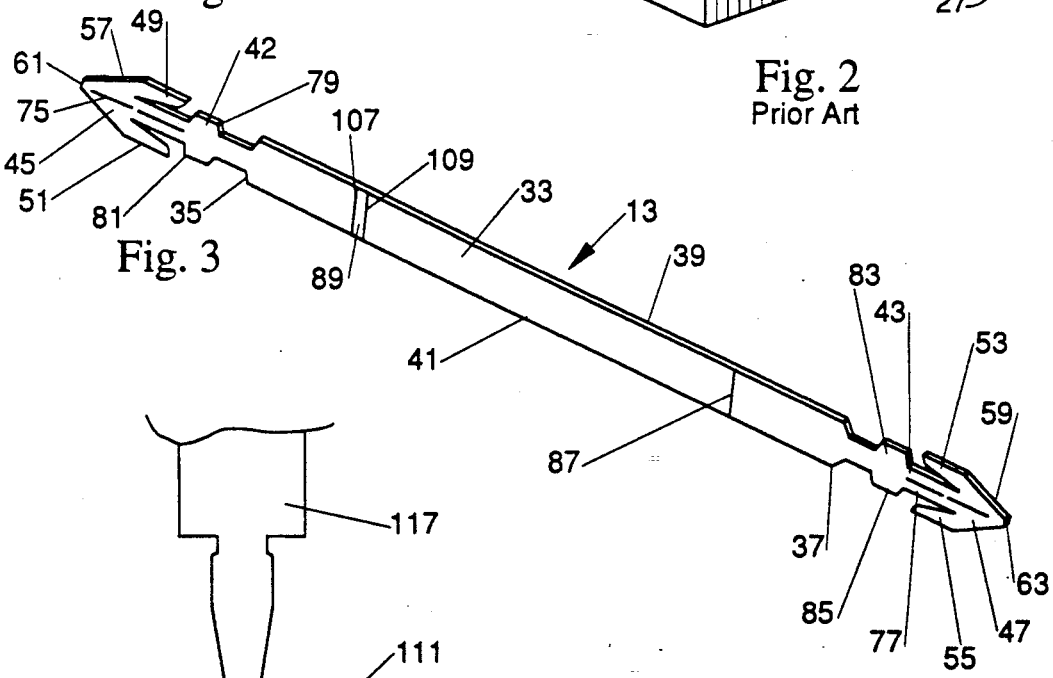
FIG. 3 is a perspective view of the bayonet handle of the invention.

FIG. 2 illustrates prior art packaging with respect to the new high concentration detergents. As with package 1, prior art package 23 has an elongated handle 25 extending over a hinged top 26. Handle 25 is attached to carton 27 by a protruding metal rivet 29 on the left narrow rectangular side 31 and a similar rivet (not shown) on the right narrow rectangular side. The bayonet handle of this invention overcomes virtually all of the problems associated with the riveted approach FIG. 3 depicts one configuration of the bayonet handle of the invention The handle 13 has a handle section 33 longitudinally extending between a first handle section terminus 35 and a second handle section terminus 37. To minimize the risk of cutting the hand of one grasping the handle 13, edges 39 and 41 are preferably rounded.

Extending longitudinally from termini 35 and 37, respectively, are elongated neck sections 42 and 43. As can easily be seen, the width of neck sections 42 and 43 is less than that of handle section 33. Attached to neck sections 42 and 43 distant from handle section 33 are barb heads 45 and 47, respectively.

Barb head 45 has thereon lateral barbs 49 and 51 which extend transversely of neck section 42 and further extend back toward the handle section 33. Similarly, barb head 47 has lateral barbs 53 and 55. At the broadest, the transverse width of the barb heads 45 and 47 will approximately equal the width of the handle section 33. Barb head end portions 57 and 59 taper and define reduced handle ends 61 and 63, respectively.

Figure 4:
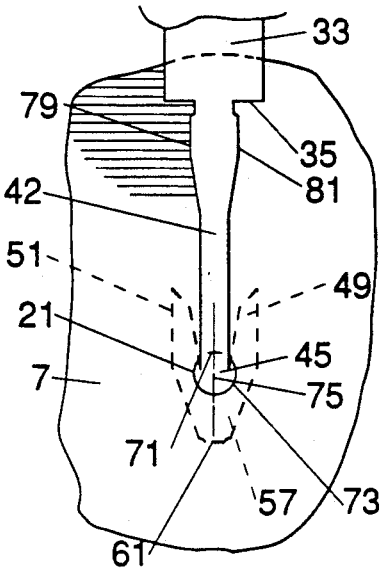
FIG. 4 is an enlarged fragmented view, partially in phantom, showing the engagement of the bayonet handle to the upper lip of the handle aperture located on the side of the soap powder carton.

FIG. 4 illustrates the manner in which handle-carton engagement is maintained in accordance with the invention. For simplicity, only the engagement of barb head 45 is shown. Barb head 47, however, is engaged in an identical way. As can be seen, barb head 45 is inserted through handle aperture 21. When the handle 13 is pulled up, barbs 49 and 51 are engaged under side 7 and are ensnared on an upper lip 71 of aperture 21.

It has been found critical that barb head 45 be sized such that the distance from end 61 to lower lip 73 of aperture 21 will always be greater than the diameter of aperture 21. Barb head 47 should be similarly sized. If the barb heads are so constructed, significantly improved drop test results are realized. The precise reasons for this phenomenon are not totally understood, but it is believed that flexing of the barb head tip may be responsible Specifically, upward stress on the handle 13 may cause barb head 45 to flex such that the tip will "pop" out of the aperture if the barb head 45 is of insufficient length.

Figure 5:
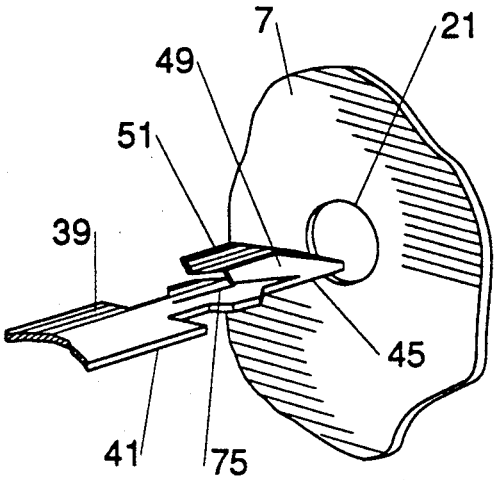
FIG. 5 is an enlarged fragmented view illustrating the method by which the bayonet handle barb heads are inserted into the handle aperture.

Referring again to FIG. 3, a pair of cut insertion scores 75 and 77 are provided to facilitate insertion of the barb heads into an aperture The cut insertion scores may comprise a series of shorter scores spaced apart and linearly orientated. Score 75 extends from end section 57 near end 61 back along neck section 42 and toward the handle section 33. Similarly, score 77 extends from end 63 back along neck section 43. As is illustrated in FIG. 5, the barb head 45 is first bent longitudinally along score 75 before being inserted into the aperture 21. Score 75 functions to remove some of the memory inherent in the plastic material. Therefore, the barb head will stay folded for a longer period of time. This process reduces the degree of accuracy required of mechanical insertion equipment, thereby allowing much higher insertion speeds than were attainable with the prior art riveted handle.

FIG. 3 illustrates retaining flanges 79 and 81, which are mounted on neck section 42 at a location between handle section 33 and barb head 45. Similar retaining flanges 83 and 85 are mounted on neck section 43. Handle section 33 carries an impressed single score 87 and an impressed double score 89. As can be readily understood with reference to FIGS. 6 and 7, retaining flanges 79, 81, 83 and 85 and scores 87 and 89 function together to facilitate shipping and display of a package incorporating the handle 13. Specifically, scores 87 and 89, which are spaced in conformity with the width of side 9, allow the handle 13 to wrap around the carton 3. The flanges 79, 81, 83 and 85 retain the handle 13 in this snug fashion until the consumer pulls out and engages the barbs. The neck sections 42 and 43 give enough length so that the consumer can pull the handle 13 over corners 91 and 93 of carton 3 into the proper carrying position The round shape of the apertures allows easy rotation of the handle 13. Since no rivets protrude from the carton 3, stacking of the packages can be carried out more effectively. This is true both before the package is assembled and filled, as well as afterwards.

Figure 6:
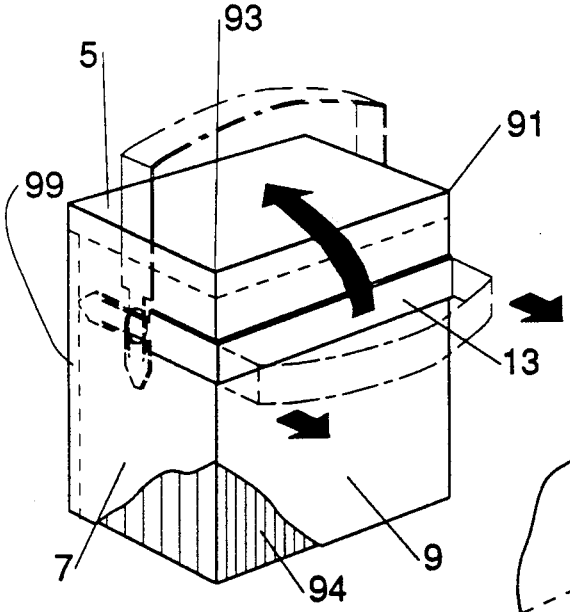
FIG. 6 is a perspective view of the soap powder package of the invention showing the shipping and display position of the handle and further illustrating in phantom the manner in which the handle is engaged and placed in carrying position.
Figure 7:
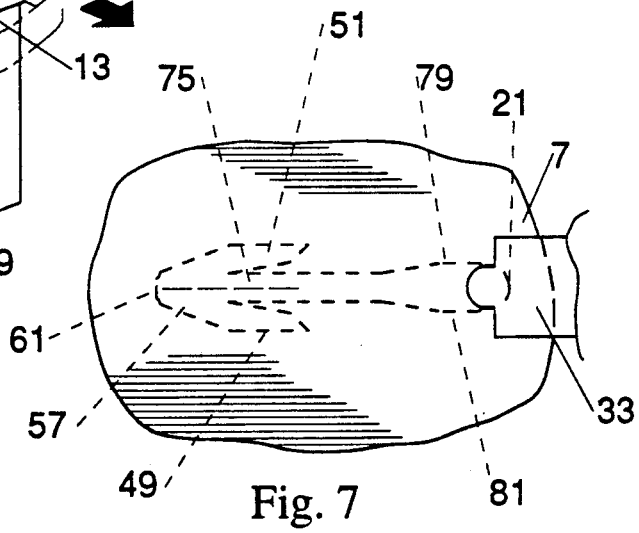
FIG. 7 is an enlarged fragmentary view, partially in phantom, showing the bayonet handle retaining flanges maintaining the handle in the display position.
Figure 8:
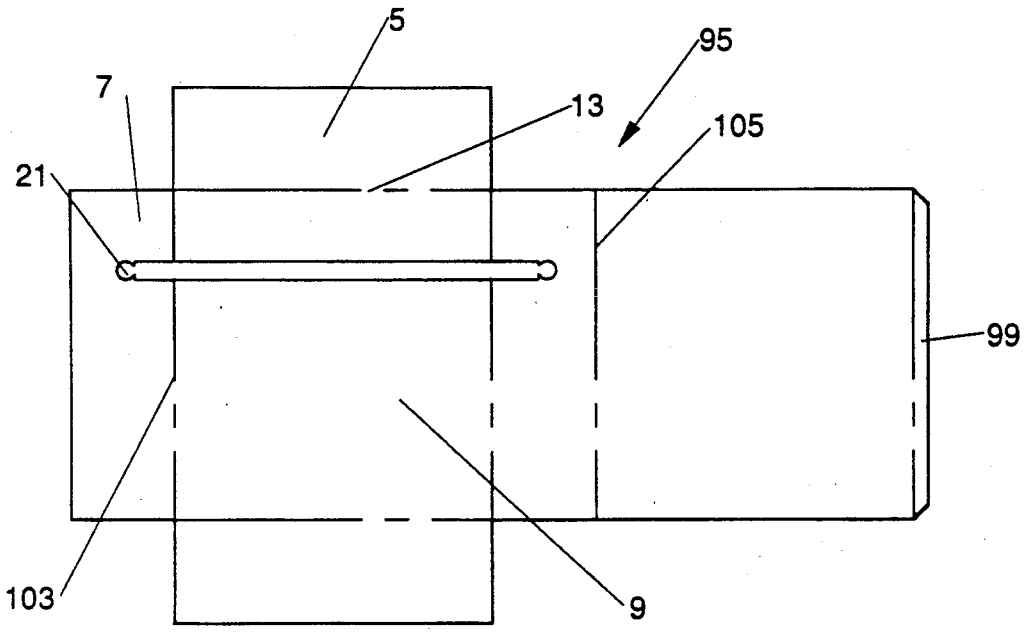
FIG. 8 is a plan view of a soap powder package blank unfolded with the bayonet handle attached.

Cartons, like carton 3, typically are of two-part construction, consisting of an outer container which is lined with an inner support liner of cardboard or the like such as liner 94 of FIG. 6. As shown in FIG. 8, the outer container begins as an unfolded cardboard blank 95 to which the handle 13 is be attached. Then, the liner is glued to the bottom of blank 95 such that when it is folded into carton 3 the inside of the sides will be lined and strengthened. With the instant invention, the liner further functions to assist in the maintenance of barb head engagement, as well as preventing contents from seeping out of the apertures. Alternatively, the liner be replaced with patches to form pockets for the barb heads and to provide strength around the apertures.

Eventually, blank 95 will be folded and glued such that glue flap 99 will partially extend under side 7, as shown in FIG. 6. Since the end 61 of handle 13 cannot be glued under flap 99, neck section 42 is necessarily of shorter length than neck section 43, as FIG. 3 clearly illustrates. Neck sections 42 and 43 could be of identical length if the handle 13 were attached to wrap around the back of the carton 3 when in the shipping and display position, as opposed to wrapping around the front as illustrated in Figure 6. However, to do so would be at the cost of consumer awareness as to the existence of the handle.

Figure 9:
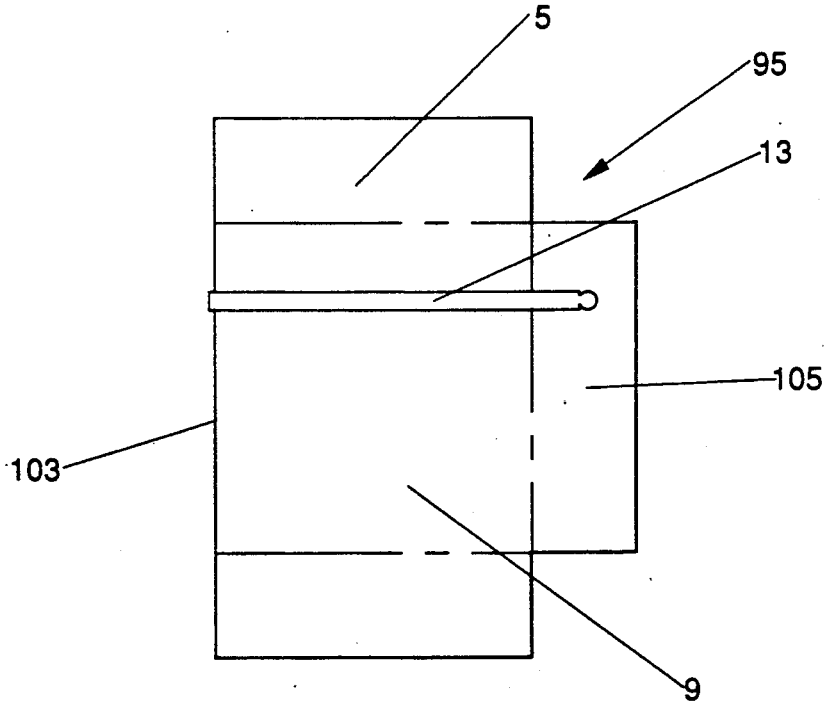
FIG. 9 is a plan view of a soap powder package blank folded and glued for shipping with the bayonet handle attached, thereby illustrating the double score of the bayonet handle effectively bending 180 degrees around a folded carton.

Generally, however, carton 3 will not be fully formed until immediately before the product is to be packaged. Also, it is very common that the assembly of the carton and the packaging of the product will occur in different facilities. When this is the case, the package is shipped in unboxed form for obvious reasons. However, for greatest efficiency, the packages will be bent along edges 103 and 105 (as shown in FIG. 9) and glued along glue flap 99. Then many such packages are stacked together. So that handle 13 may effectively bend 180 degrees around edge 103, double score 89 is formed such that a pair of impressed score seams 107 and 109 are adjacent and parallel to one another. A single score, such as 87, would be incapable of making this 180 degree bend without deformation or additional stress on the retaining flanges which may disengage while the carton is folded.

Figure 10:
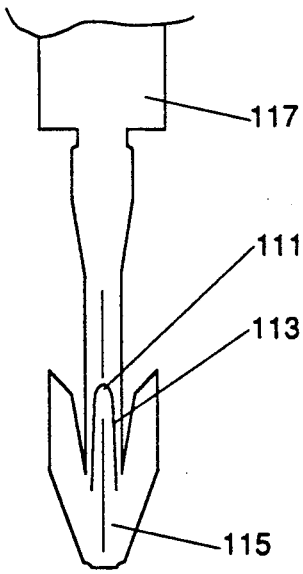
FIG. 10 is an elevated fragmentary view illustrating an alternative three-barb per head bayonet handle configuration

FIG. 10 illustrates an alternative configuration of the bayonet handle of the invention wherein a third, inner barb 111 is formed from a tongue-shaped cut score 113 in the center portion of barb head 115. This approach gives the three-barb handle 117 drop test result somewhat improved over the two-barb configuration. However, three-barb handles have been found to be more difficult to insert with mechanical insertion equipment. Furthermore, the typical weight of a package of soap powder will not require the added strength. Therefore, a two-barb handle, such as 13, is preferred on balance for the typical anticipated applications of the invention. However, other applications wherein a three-barb handle would be preferred ar conceivable and the invention is intended to encompass these applications as well.

It can thus be seen that when a carton is equipped with a handle constructed in accordance with the invention a novel package for the containment and transportation of soap powder or the like is furnished. The package is superior to the prior art in practically every aspect, including speed of manufacture, efficiency in storing and shipping and recyclability. As many variations will become apparent to one of skill in the art from a reading of the above description, such modifications are within the scope of this invention as defined by the following appended claims.

That which is claimed is:

1. A bayonet handle for use with a carton for the containment and transportation of soap powder or the like, said handle constructed of a single piece of straplike, flat, flexible material having a generally uniform thickness and comprising:

an elongated handle section extending longitudinally between a first and second terminus;

a first elongated neck section extending longitudinally from said first terminus of said handle section and having a width less than that of said handle section;

a first barb head attached to said first neck section distant from said handle section and including a tapered first end portion defining a first reduced end of said bayonet handle, said first barb head further including a first pair of barbs, a single barb of said first pair located on each side of said first barb head and extending transversely thereof and further extending adjacent said first neck section back toward said handle section;

a second elongated neck section extending longitudinally from an end of said second terminus of said handle section and having a width less than that of said handle section, said first elongated neck section being longer than said second elongated neck section; and a second barb head attached to said second neck section distant from said handle section and including a tapered second end portion defining a second reduced end of said bayonet handle, said second barb head further including a second pair of barbs, a single barb of said second pair located on each side of said second barb head and extending transversely thereof and further extending adjacent said second neck section back toward said handle section.

2. The bayonet handle constructed in accordance with claim 1 wherein said barbs of said first and second barb heads extend transversely of the respective neck section to a combined width approximately equal to the width of said handle section.

3. The bayonet handle constructed in accordance with claim 1 further comprising a pair of retaining flanges on each said neck section at a location between said handle section and the adjacent barb head, a single flange extending laterally on each side of each said neck section.

4. The bayonet handle constructed in accordance with claim 1 wherein said flexible material is resilient plastic material.

5. The bayonet handle constructed in accordance with claim 4 wherein said resilient plastic material is recycled polyethylene.

6. The bayonet handle constructed in accordance with claim 4 wherein said handle section has rounded edges.

7. The bayonet handle constructed in accordance with claim 1 further comprising a pair of insertion scores, one insertion score of said pair extending longitudinally from one end portion of said bayonet handle back along the first neck section, another insertion source of said pair similarly extending longitudinally from the second end portion of said handle back along the second neck section.

8. The bayonet handle constructed in accordance with claim 1 further comprising a first inner barb located on each said barb head, said first inner barbs formed by a tongue-shaped score in each said barb head.

9. A bayonet handle for use with a carton of soap powder or the like and constructed of a single piece of straplike, flat, flexible material having a generally uniform thickness comprising:

an elongated handle section extending longitudinally between a first and second terminus;

a first elongated neck section extending longitudinally from said first terminus of said handle section and having a width less than that of said handle section;

a first barb head attached to said first neck section distant from said handle section and including a tapered first end portion defining a first reduced end of said bayonet handle, said first barb head further including a first pair of lateral barbs and a first inner barb, a single barb of said first lateral barb pair located on each side of said first neck portion extending transversely thereof and further extending adjacent said first neck section back toward said handle section, said first inner barb defined by a tongue-shaped score in said first barb head;

a second elongated neck section extending longitudinally from an end of said second terminus of said handle section and having a width less than that of said handle section, said first elongated neck section being larger than said second elongated neck section; and a second barb head attached to said second neck section distant from said handle section and including a second tapered end portion defining a second reduced end of said bayonet handle, said second barb head further including a second pair of lateral barbs and a second inner barb, a single barb of said second lateral barb pair located on each side of said second neck section and extending transversely thereof and further extending adjacent said second neck section back toward said handle section, said second inner barb defined by a tongue-shaped score in said second barb head.

10. The bayonet handle constructed in accordance with claim 9 wherein said lateral barbs of said first and second barb heads extend transversely of the respective neck section to a combined width approximately equal to the width of said handle section.

11. The bayonet handle constructed in accordance with claim 1 further comprising a pair of retaining flanges on each said neck section at a location between said handle section and the adjacent barb head, a single flange extending laterally on each side of each said neck section.

12. The bayonet handle constructed in accordance with claim 9 wherein said flexible material is resilient plastic material.

13. The bayonet handle constructed in accordance with claim 12 wherein said resilient plastic material is recycled polyethylene.

14. The bayonet handle constructed in accordance with claim 12 wherein said handle section has rounded edges.

15. The bayonet handle constructed in accordance with claim 12 further comprising a pair of insertion scores, one insertion score of said pair extending longitudinally from one end portion of said bayonet handle back along the first neck section, another insertion score of said pair similarly extending longitudinally from the second end portion of said handle back along the second neck section.

* * * * *

UNITED STATES PATENT AND TRADEMARK OFFICE

CERTIFICATE OF CORRECTION

PATENT NO. : 5,137,209

DATED : August 11, 1992

INVENTOR(S) : JOHN T. ROBERTS ET AL.

It is certified that error appears in the above-identified patent and that said Letters Patent is hereby corrected as shown below:

In the ABSTRACT, line 10, "apparatus" should read -- apertures --.

Column 1, line 46, "form" should read -- from --.

Column 2, line 64, after "material" insert -- . --. The correct form appears in the specification at page 5, line 6.

Column 3, line 26, after "material" insert -- . --. The correct form appears in the specification at page 6, line 7.

Column 3, line 43, after "invention" insert -- . --. The correct form appears in the specification at page 6, line 23.

Column 4, line 11, after "responsible" insert -- . --. The correct form appears in the specification at page 8, line 2.

Column 4, line 17, after "aperture" insert -- . --. The correct form appears in the specification at page 8, line 8.

Column 4, line 50, after "position" insert -- . --. The correct form appears in the specification at page 9, line 8.

Column 4, line 60, delete -- be --.

Column 4, line 66, after "liner" insert -- may --. The correct form appears in the specification at page 9, line 23.

UNITED STATES PATENT AND TRADEMARK OFFICE

CERTIFICATE OF CORRECTION

PATENT NO. : 5,137,209

DATED : August 11, 1992

INVENTOR(S) : JOHN T. ROBERTS ET AL.

It is certified that error appears in the above-identified patent and that said Letters Patent is hereby corrected as shown below:

Column 5, line 44, delete "ar" and insert therefor -- are --. The correct form appears in the specification at page 11, line 10.

Column 6, line 6 of Claim 7, delete "source" and insert therefor -- score --. The correct form appears in the specification at page 13, original Claim 8.

Signed and Sealed this

Eighth Day of March, 1994

Bruce Lehman

*Attest:*

BRUCE LEHMAN

*Attesting Officer*

*Commissioner of Patents and Trademarks*